US011052927B2

(12) United States Patent
Lin et al.

(10) Patent No.: US 11,052,927 B2
(45) Date of Patent: Jul. 6, 2021

(54) RAILROAD HOPPER CAR

(71) Applicant: CRRC YANGTZE CO., LTD., Wuhan (CN)

(72) Inventors: Liangcai Lin, Wuhan (CN); Biaowen Xiang, Wuhan (CN); Chuqiang Tang, Wuhan (CN); Hong Cui, Wuhan (CN); Yueming Hu, Wuhan (CN); Song Wang, Wuhan (CN); Xuebin Zhu, Wuhan (CN); Rui Yan, Wuhan (CN); Chuanping Zheng, Wuhan (CN); Qi Wei, Wuhan (CN)

(73) Assignee: CRRC Yangtze Co., Ltd., Wuhan (CN)

( * ) Notice: Subject to any disclaimer, the term of this patent is extended or adjusted under 35 U.S.C. 154(b) by 357 days.

(21) Appl. No.: 16/338,365

(22) PCT Filed: Jul. 21, 2017

(86) PCT No.: PCT/CN2017/093766

§ 371 (c)(1),
(2) Date: Mar. 29, 2019

(87) PCT Pub. No.: WO2018/068553

PCT Pub. Date: Apr. 19, 2018

(65) Prior Publication Data

US 2020/0023867 A1 Jan. 23, 2020

(30) Foreign Application Priority Data

Oct. 13, 2016 (CN) ..... 201610900465.1
Oct. 13, 2016 (CN) ..... 201621126920.9

(51) Int. Cl.
*B61D 7/02* (2006.01)
*B61D 7/18* (2006.01)
(Continued)

(52) U.S. Cl.
CPC ..... *B61D 7/02* (2013.01); *B61D 7/18* (2013.01); *B61D 39/001* (2013.01); *B61D 7/28* (2013.01)

(58) Field of Classification Search
CPC ... B61D 7/02; B61D 7/18; B61D 7/28; B61D 39/001
See application file for complete search history.

(56) References Cited

U.S. PATENT DOCUMENTS 2,630,767 A * 3/1953 Dorey ..... B61D 7/06 105/251
3,572,252 A * 3/1971 Coover et al. ..... B61D 7/00 105/248

(Continued)

FOREIGN PATENT DOCUMENTS

CN 101480956 A 7/2009
CN 102795234 A 11/2012

(Continued)

OTHER PUBLICATIONS

International Search Report prepared by the State Intellectual Property Office of the P.R. China for PCT/CN2017/093766, dated Oct. 26, 2017, 8 pages.

(Continued)

*Primary Examiner* — Jason C Smith
(74) *Attorney, Agent, or Firm* — Chernoff Vilhauer LLC

(57) ABSTRACT

Disclosed is a railway hopper car comprising a car body (6), a top cover (1, 2), a bogie (24), a braking device (21), a coupler buffer device (22), and a bottom door (25, 28) and a bottom door opening and closing mechanism (23) mounted at a discharge port at the bottom of a chassis. The railway hopper car further comprises a longitudinal saddle (31) disposed in the center of the car body (6) in the length direction thereof and arranged along the longitudinal direction of the car body (6). By providing the longitudinal saddle (Continued)

(31), the sequential requirement to close the left bottom door (25) and the right bottom door (28) is eliminated, thereby simplifying the structure of the linkage bottom door opening and closing mechanism and reducing manufacture and maintenance costs thereof.

14 Claims, 8 Drawing Sheets

(51) Int. Cl.
*B61D 39/00* (2006.01)
*B61D 7/28* (2006.01)

(56) References Cited

U.S. PATENT DOCUMENTS 4,594,948 A * 6/1986 Smith ..... B61D 7/02 105/248
5,458,067 A * 10/1995 Weiss ..... B61D 7/02 105/406.1
6,510,800 B1 * 1/2003 Zaerr ..... B61D 3/12 105/355
2005/0056186 A1 * 3/2005 Creighton ..... B61D 7/02 105/286
2010/0275811 A1 * 11/2010 Creighton ..... B61D 7/24 105/307
2015/0353102 A1 * 12/2015 Shi ..... B61D 7/26 105/296
2018/0345997 A1 * 12/2018 Reitz ..... B61D 7/06
2020/0023867 A1 * 1/2020 Lin ..... B61D 39/001
2020/0353954 A1 * 11/2020 Veit ..... B61D 7/18

FOREIGN PATENT DOCUMENTS

CN 105292159 A 2/2016
CN 106347384 A 1/2017
CN 106347385 A 1/2017
CN 106394588 A 2/2017
CN 206155450 U 5/2017
CN 206155451 U 5/2017
CN 206155461 U 5/2017
JP 2008296914 A 12/2008

OTHER PUBLICATIONS

Written Opinion prepared by the State Intellectual Property Office of the P.R, China for PCT/CN2017/093766, dated Oct. 26, 2017, 4 pages.
First Office Action prepared by the State Intellectual Property Office of the P.R. China for CN 201610900465.1; dated Dec. 14, 2017, 10 pages.

* cited by examiner

RAILROAD HOPPER CAR

CROSS-REFERENCE TO RELATED APPLICATIONS

This is a national stage application filed under 35 USC 371 based on International Application No. PCT/CN2017/093766 filed Jul. 21, 2017 and claims priority under 35 USC 119 of Chinese Patent Application No. 201610900465.1 filed Oct. 13, 2016 and Chinese Patent Application No. 201621126920.9 filed Oct. 13, 2016.

TECHNICAL FIELD

The disclosure relates to the field of railway transportation vehicles, and in particular to a railway hopper car.

BACKGROUND OF THE INVENTION

A railway hopper car is a railway vehicle used to transport loose minerals such as coal, ore, sand, cement clinker and salt and to achieve self-unloading and unloading-while-moving functions. At present, a bottom door of a railway hopper car is mainly configured in the following structural forms: a saddled lateral unloading longitudinal structure, a saddleless central unloading longitudinal structure and a central unloading transversal structure, with a length direction of a vehicle being a longitudinal direction and a width direction of the vehicle being a transversal direction, and an unloading at a center of a track being a central unloading and an unloading to lateral sides of the track being a lateral unloading. For different structural types of the bottom door, corresponding top cover opening and closing mechanisms and control systems are adopted.

FIG. 1 shows a saddleless central unloading longitudinal structure of a bottom door, including a car body 6, a left bottom door 25, a right bottom door 28 and a bottom door opening and closing mechanism 23. The left bottom door 25 and the right bottom door 28 are symmetrically arranged about a longitudinal center line of the car body 6 in the length direction thereof and mounted at the bottom of a discharge port of the car body, and the left bottom door 25 and the right bottom door 28 are overlapped with each other throughout the length thereof in the longitudinal direction of the car body in a closed position. The left bottom door and the right bottom door are opened and closed by an integral master and slave linkage opening and closing mechanism, in which the door connected to the opening and closing cylinder is an active bottom door, and the other door is a passive bottom door.

Since the order of closing the active bottom door and the passive bottom door is randomly changed, in order to ensure that the active bottom door is located below while the passive bottom door is located above when the bottom door is closed, the bottom door opening and closing mechanism must be additionally equipped with a sequence cylinder or sequence device 26 for the closing of the passive bottom door, as shown in FIG. 1. However, this results in a complicated structure and a reduced operational reliability. In addition, for vehicles with a large width such as a wide gauge, the width of the bottom door is also relatively large and cannot be adjusted, which causes the bottom door to invade a limited area under the vehicle when the bottom door is fully opened, and the safety requirements of vehicle operation cannot be met. Moreover, the opening degree of the bottom door of the vehicle is basically determined by the width of the vehicle, so that on the condition that the length and width of the vehicle are determined, a cargo unloading flow of the vehicle cannot be adjusted, thus it is difficult to adapt to the matching requirements of the ground transit facilities of different capacities. Finally, on the condition that the length and width of the vehicle are determined, the width of the bottom door is large, resulting in a large self-weight and an increased force for closing the bottom door. In this situation, the bottom door is usually not able to be properly closed due to insufficient closing force.

In addition, for vehicles loading cargoes that need to be protected from rain, sand and other contamination, a movable top cover is required on the top of the car body. Therefore, railway hopper cars are generally divided into covered railway hopper cars and coverless railway hopper cars according to the structural type. A top cover of a covered railway hopper car is a single-layer top cover, including a movable top cover that is opened and closed by a top cover opening and closing mechanism, and a detachable fixed top cover that is integrally connected with the car body and provided with a loading port. At present, various railway hopper cars adopt corresponding top cover structure types according to conditions of loading facilities and characteristics of cargoes. Each kind of vehicle is generally used for loading and transporting one kind of cargoes or cargoes of similar characteristics, so that the kinds of cargoes to be loaded are relatively few and the applicability is poor.

SUMMARY OF THE INVENTION

To address the problems in the prior art, an aspect of the present disclosure is to provide a railway hopper car with simple structure, good opening and closing performance and high versatility, so as to improve the applicability of the railway hopper car and realize loading and transportation of various kinds of cargoes of different characteristics, so that the railway hopper car can adapt to different conditions of a variety of loading facilities.

To achieve the above object, a railway hopper car designed by the present disclosure comprises a car body and a top cover mounted at a top opening of the car body, and a bogie, a braking device and a coupler buffer device each mounted under a chassis of the car body, as well as a bottom door and a bottom door opening and closing mechanism mounted at a discharge port at the bottom of the chassis, wherein the bottom door includes a left bottom door and a right bottom door rotatably mounted at the bottom of the discharge port of the car body, and the left bottom door and the right bottom door are symmetrically arranged about a longitudinal central line of the car body in a length direction thereof, and wherein the railway hopper car further comprises a longitudinal saddle disposed in the center of the car body in the length direction thereof and arranged along the longitudinal direction of the car body, and wherein the longitudinal saddle includes two side plates and a saddle top connected tops of the two side plates, as well as lower side beams respectively disposed below inner side surfaces of the side plates, and two ends of each of the two side plates are respectively fixed to end plates of the discharge port of the car body through end connecting plates at both ends of the discharge port; the bottom door opening and closing mechanism drives the left bottom door and the right bottom door to rotate, so that an inner edge of the left bottom door and an inner edge of the right bottom door are respectively overlapped with or separated from the lower side beams at two sides of the longitudinal saddle; and The top cover is a double-layer top cover, and the double-layer top cover comprises a fixed top cover, a movable top cover and a top cover opening and closing mechanism, and the fixed top cover is detachably connected to the top opening of the car body, and the movable top cover is movably connected to the top opening of the car body through the top cover opening and closing mechanism; the top cover opening and closing mechanism includes a rocker with one end fixedly connected to an end of the movable top cover and a rocker support connected to the other end of the rocker through a pin shaft, the rocker support being fixed to an end wall of the car body.

In some embodiments, the bottom door opening and closing mechanism includes a first connecting rod, a second connecting rod hinged with the first connecting rod, a driving cylinder connected to an end beam of the car body, a swing rod hinged with the driving cylinder, a third connecting rod hinged with the swing rod, and a transmission shaft fixedly connected to the first connecting rod. The second connecting rod is hinged with the left bottom door, and the transmission shaft is hinged with two ends of the right bottom door, and a piston rod end of the driving cylinder is hinged with one end of the swing rod, and the other end of the swing rod is hinged with the third connecting rod, and the other end of the third connecting rod is fixedly connected to the transmission shaft. A center of rotation between the connection of the third connecting rod and the transmission shaft, a center of rotation between the connection of the first connecting rod and the transmission shaft, and a hinged center formed by the transmission shaft and the right bottom door coincide with one another.

In some embodiments, the fixed top cover may comprise a frame, a cover plate mounted on the frame, a loading port formed in the cover plate, and a lifting ring provided on the cover plate for lifting. An edge of the frame is fixedly mounted by bolts on an outer edge extended outward from the top of the side walls of the car body. Two ends of the frame are sealingly connected with end walls of the car body through a rubber sealing gasket, and the rubber sealing gasket is fixed by welding on an end edge of the frame through a dovetail channel iron. A side sealing gasket is lined between the edge of the frame and the outer edge, and the side sealing gasket is riveted to the edge of the frame by rivets.

In some embodiments, the edge of the frame may be an L-shaped beam, and the L-shaped beam includes a transversal edge and a vertical edge. The transversal edge is fixedly mounted by bolts on the outer edge extending outward from the top end of the side walls of the car body, and there is a gap between the vertical edge and an inner surface of the side walls of the car body.

In some embodiments, two longitudinal top ends of the left bottom door are respectively hinged on two lifting lugs on one side of the lower surface of the end beam, and a longitudinal outer edge of the left bottom door is in contact with a side beam on one side of the car body. Two longitudinal top ends of the right bottom door are respectively hinged on two lifting lugs on the other side of the lower surface of the end beam, and a longitudinal outer edge of the right bottom door is in contact with a side beam on the other side of the car body.

In some embodiments, a plurality of partition plates may be provided between the two side plates along the length direction of the longitudinal saddle.

In some embodiments, a transversal width of each of the left bottom door and the right bottom door is inversely proportional to a transversal width of the bottom of the vertical saddle.

In some embodiments, the movable top cover may be a one-side opening movable top cover or a double-side opening movable top cover.

Compared with the prior art, the present disclosure has the following advantages:

1. By providing the longitudinal saddle, the sequential requirement to close the left bottom door and the right bottom door is eliminated, thereby removing the sequence cylinder or sequence device in the existing linkage bottom door opening and closing mechanism, thus the structure of the linkage bottom door opening and closing mechanism is simplified, manufacture and maintenance costs thereof are reduced and the operational reliability thereof is further improved.

2. On the condition that the length and width of a vehicle are determined, the transversal widths of the left bottom door and the right bottom door and the opening degrees thereof can be adjusted by adjusting a transversal width L of the bottom of the longitudinal saddle. Accordingly, on the one hand, it solves the problem that the bottom door of a vehicle with a large width such as a wide gauge invades into a limited area under the vehicle when the bottom is fully opened; on the other hand, it reduces the self-weight and closing force of the bottom door, thus further improving opening and closing performance. Further, it realizes adjustment and control of cargo unloading flow and improves the ability of the vehicle to adapt to ground transit facilities of different capacities.

3. For a vehicle operating in a certain condition and carrying a certain cargo or operating under other constant conditions, a longitudinal saddle with parameters of a transversal bottom width L and a side plate inclination $\alpha$ which are matched with the vehicle may be used. For a vehicle operating in various conditions and carrying various kinds of cargoes, a longitudinal saddle with a series of parameters of transversal bottom widths L and side plate inclinations $\alpha$ may be used, so that the longitudinal saddle can be replaced corresponding to different operating conditions and different cargoes and the versatility of the railway hopper car can be improved.

4. With a double-layer top cover consisting of a detachable fixed top cover and an openable movable top cover, it effectively increases the range of cargoes that can be loaded by a covered hopper car. By replacing a fixed top cover with another fixed top cover of a different form of loading port or directly disassembling the fixed top cover, the requirements for the covered hopper car to load a variety of cargoes and adapt to a variety of ground loading facilities can be met, thereby increasing the capability of the car to transport different kinds of cargoes of different characteristics, enhancing the capability of the car to adapt to different conditions of different kinds of cargo loading facilities, and achieving multi-purpose use of a single car and greatly improving applicable performance of the car, and further improving transportation and operation efficiency of the car.

LIST OF REFERENCE NUMBERS

1: fixed top cover; 2: movable top cover; 3: top cover opening and closing mechanism; 4: end wall; 5: side wall; 6: car body; 7: pin shaft: 8: rocker; 9: rocker support; 10: frame; 11: L-shaped beam; 12: cover plate; 13: loading port; 14: lifting ring; 15: transversal edge; 16: vertical edge; 17: side sealing gasket; 18: outer edge; 19: rivet; 20: double-layer top cover; 21: braking device; 22: coupler buffer device; 23: bottom door opening and closing mechanism; 24: bogie; 25: left bottom door; 26: sequence cylinder; 27: end connecting plate; 28: right bottom door; 29: side beam; 30: end beam; 31: longitudinal saddle (wherein, 31.1: side plate; 31.2: saddle top; 31.3: lower side beam; 31.4: partition plate); 32: lifting lug; 33: second connecting rod; 34: swing rod; 35: first connecting rod; 36: driving cylinder; 37: inner edge of left bottom door; 38: inner edge of right bottom door; 39: transmission shaft; 40: third connecting rod; 41: rubber sealing gasket; 42: dovetail channel iron.

DETAILED DESCRIPTION OF THE INVENTION

The disclosure will be further described in detail below in conjunction with accompanying drawings and specific embodiments.

Figure 1:
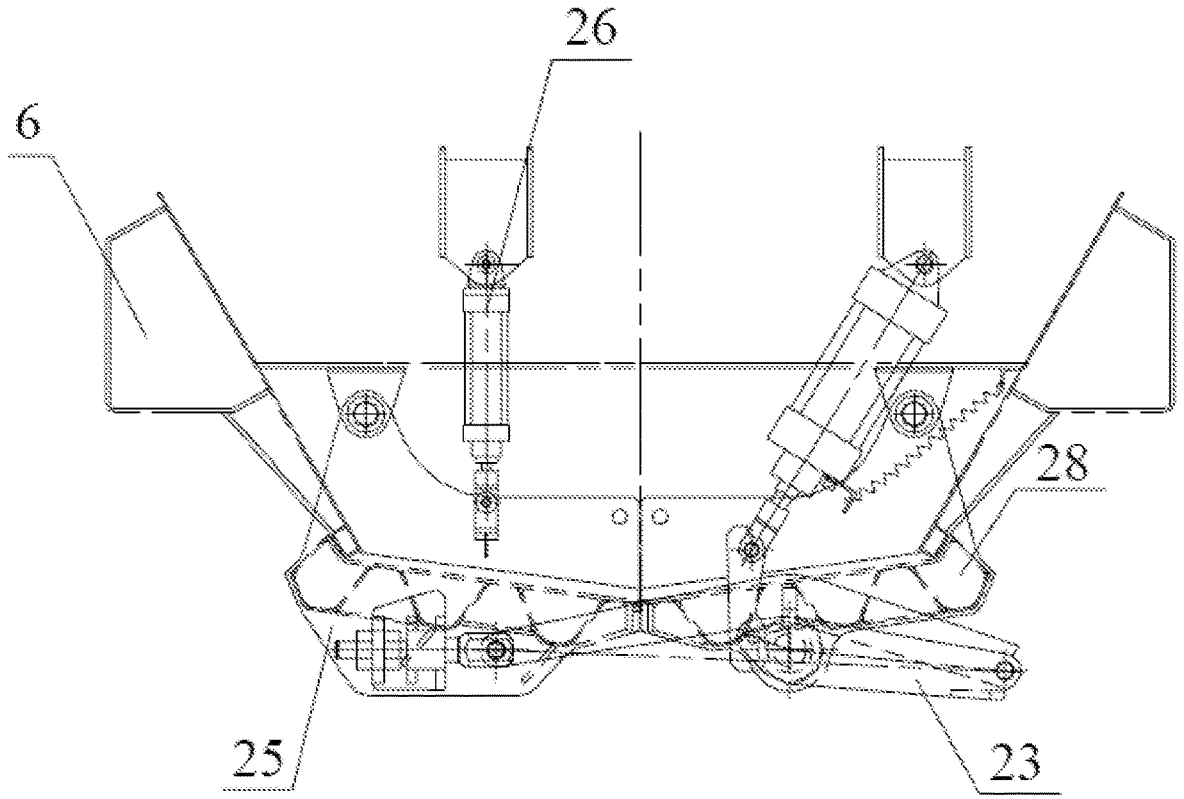
FIG. 1 is a schematic structural view of a bottom door of a railway hopper car in the prior art.
Figure 2:
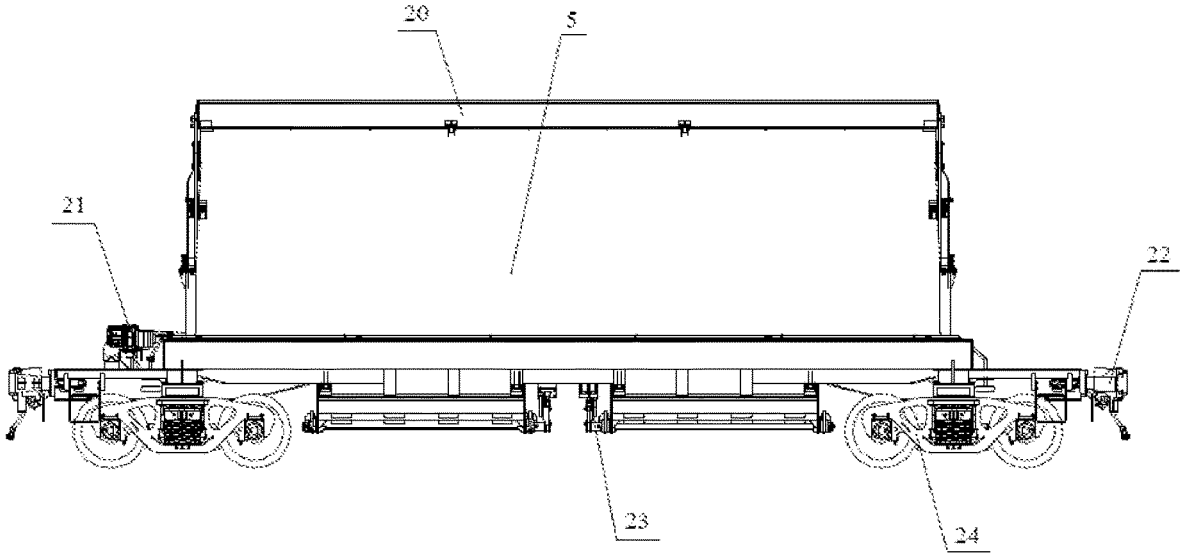
FIG. 2 is a schematic structural view of a railway hopper car according to an embodiment of the present invention.

FIG. 2 shows a railway hopper car. The railway hopper car includes a car body 6 and a top cover mounted at a top opening of the car body 6, and a bogie 24, a braking device 21 and a coupler buffer device 22 each mounted on a chassis of the car body 6, as well as a bottom door and a bottom door opening and closing mechanism 23 mounted at a discharge port at a bottom of the chassis. The bogie 24, the braking device 21 and the coupler buffer device 22 in the present embodiment may be the same as in the prior art. In addition, the car body 6 has side walls 5 and end walls 4 which form a top loading port (i.e., opening), and the top portion of the top loading port is throughout the length of the car in a longitudinal direction of the car. The loading port has a structure and an interface which are matched with a structure of the top cover to ensure that the top of the car is sealed. A single or multiple hopper openings may be provided at the bottom of the chassis.

Figure 10:
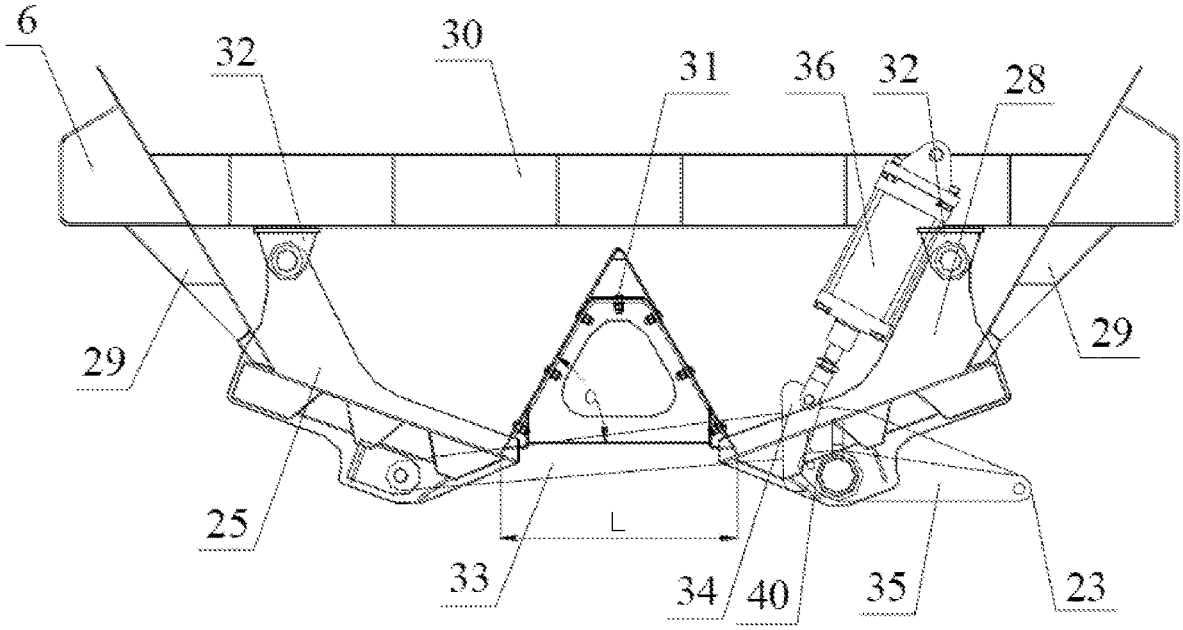
FIG. 10 is a schematic view showing a transversal arrangement structure and a closed state of a bottom door of a railway hopper car according to an embodiment of the present invention.
Figure 11:
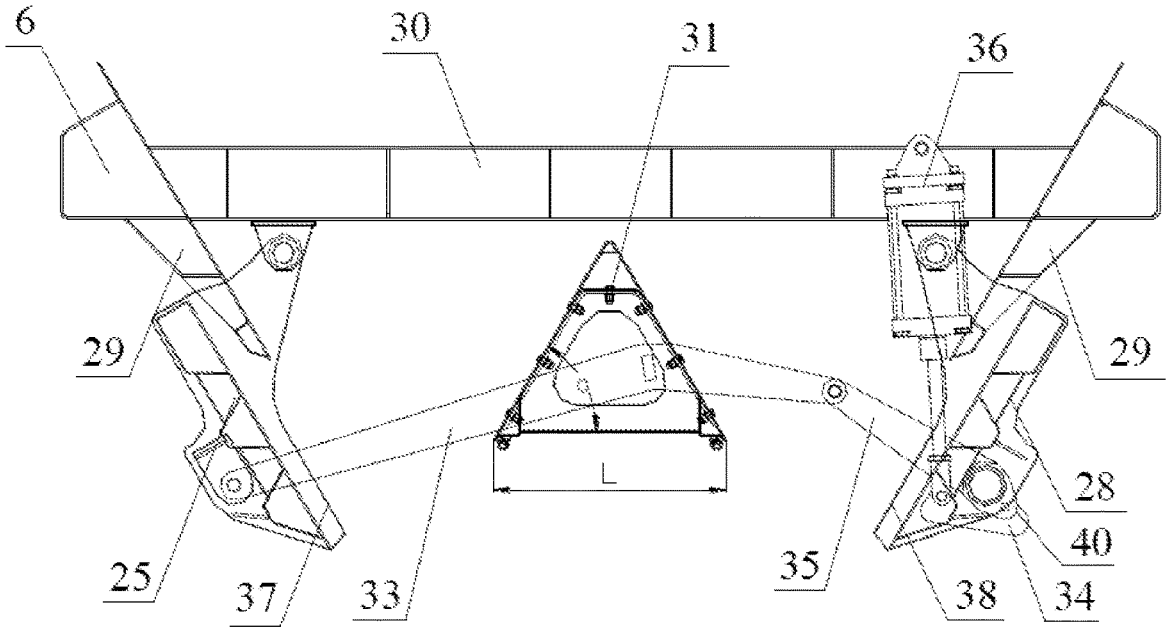
FIG. 11 is a schematic view showing a transversal arrangement structure and an open state of a bottom door of a railway hopper car according to an embodiment of the present invention.
Figure 12:
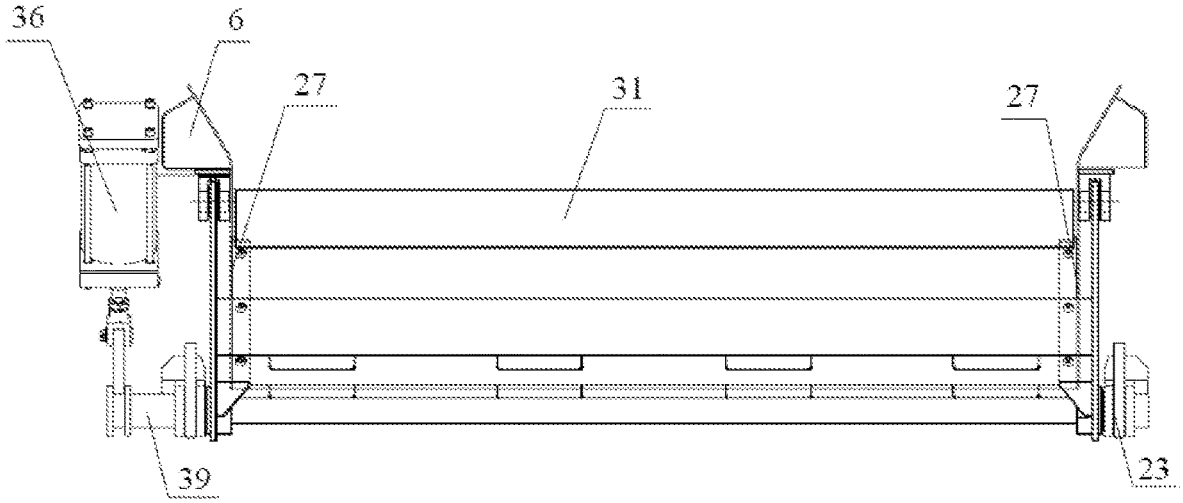
FIG. 12 is a schematic view showing a longitudinal arrangement structure of a bottom door of a railway hopper car according to an embodiment of the present invention.
Figure 13:
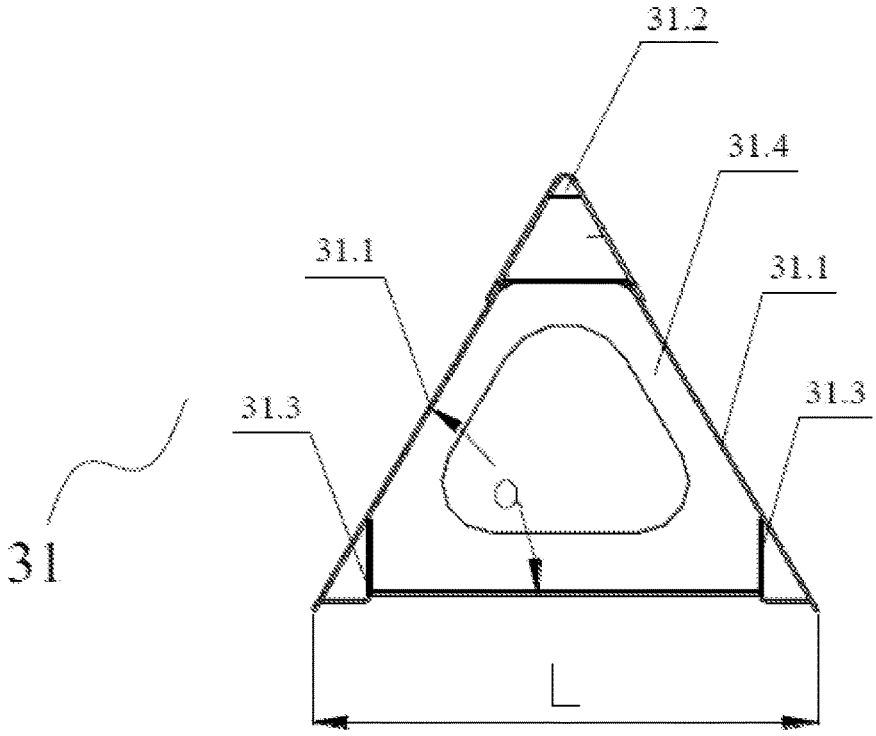
FIG. 13 is a schematic view showing a transversal arrangement structure of a longitudinal saddle according to an embodiment of the present invention.
Figure 14:
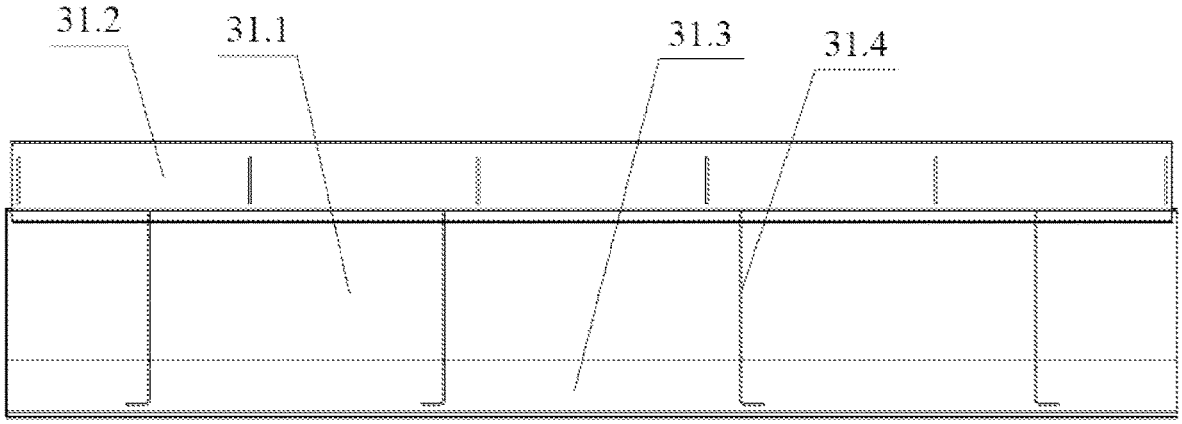
FIG. 14 is a schematic view showing a longitudinal arrangement structure of a longitudinal saddle according to an embodiment of the present invention.

In conjunction with FIGS. 10, 11, and 12, the bottom door includes a left bottom door 25 and a right bottom door 28 which are rotatably mounted at the bottom of the discharge port of the car body 6, and the bottom door opening and closing mechanism 23 for opening the bottom door. The left bottom door 25 and the right bottom door 28 are symmetrically arranged along a longitudinal central line of the car body 6 in the length direction, thereby achieving unloading at the center of a track. A key point of the disclosure is including a longitudinal saddle 31 disposed in the center of the car body 6 in the length direction and arranged along the longitudinal direction of the car body. The longitudinal saddle 31 divides the discharge port into a left discharge port and a right discharge port. Referring to FIGS. 13 and 14, the longitudinal saddle 31 includes two side plates 31.1, a saddle top 31.2 connecting the tops of the two side plates 31.1, and lower side beams 31.3 respectively disposed below inner side surfaces of the side plates 31.1. In this embodiment, an inclination angle $\alpha$ between the two side plates 31.1 is an acute angle, preferably in a range of 60° to 75°. Both ends of each of the two side plates 31.1 are respectively fixed to end plates of the car body 6 through end connecting plates 27 at both ends of the discharge port. That is, one end of the longitudinal saddle 31 in a transversal direction thereof is welded or bolted to an end connecting plate on one side of the end plate of the car body 6, and the other end of the longitudinal saddle 31 in the transversal direction thereof is welded or bolted to an end connecting plate 27 on the other side of the end plate of the car body 6, while the tops of the two end connecting plates 27 are both connected to the end plate of the car body 6. Further, since the length direction of the car body is relatively long, the length direction of the longitudinal saddle is also relatively long. In order to strengthen the mechanical strength of the longitudinal saddle, a plurality of partition plates 31.4 are provided between the two side plates along the length direction of the longitudinal saddle 31 for supporting.

The left bottom door 25 is suspended and mounted right under the left discharge port of the car body 6, and is arranged longitudinally along the length direction of the car body 6. On one side of the lower surface of an end beam 30, two lifting lugs 32 are provided downward. A top portion of the left bottom door 25 is inserted between the two lifting lugs 32. At the same time, two longitudinal ends of the left bottom door 25 are respectively hinged on the two lifting lugs 32 on the one side of the lower surface of the end beam 30, so that the left bottom door 25 can pivot around a hinge point toward an inner side and an outer side of the car body 6, and a longitudinal outer edge of the left bottom door 25 is in contact with a side beam 29 on one side of the car body 6. Similarly, the right bottom door 28 is suspended and mounted right under the right discharge port of the car body 6 and is longitudinally arranged along the length direction of the car body 6. Also, on the other side of the lower surface of an end beam 30, two lifting lugs 32 are provided downward. A top portion of the right bottom door 28 is inserted between the two lifting lugs 32 and two longitudinal ends of the right bottom door 28 are respectively hinged on the two lifting lugs 32 on the other side of the lower surface of the end beam 30, so that the right bottom door 28 can pivot around a hinge point toward an inner side and an outer side of the car body 6, and a longitudinal outer edge of the right bottom door 28 is in contact with a side beam 29 on the other side of the car body 6.

In the present disclosure, the bottom door opening and closing mechanism 23 drives the left bottom door 25 and the right bottom door 28 to rotate toward the inner side and the outer side of the car body 6, so that an inner edge 37 of the left bottom door and an inner edge 38 of the right bottom door are respectively overlapped with or separated from the lower side beams 31.3 on the two sides of the longitudinal saddle 31. That is, the inner edge 37 of the left bottom door is overlapped with or separated from the lower side beam 31.3 on the left side of the longitudinal saddle 31, and the inner edge 38 of the right bottom door is overlapped with or separated from the lower side beam 31.3 of the right side of the longitudinal saddle 31, thus the closing or opening of the bottom door is achieved and an automatic unloading is realized. In the present embodiment, the bottom door opening and closing mechanism 23 includes a first connecting rod 35, a second connecting rod 33 hinged with the first connecting rod 35, a driving cylinder 36 connected to the end beam 30 of the car body 6, a swing rod 34 hinged with the driving cylinder 36, a third connecting rod 40 hinged with the swing rod 34 and a transmission shaft 39 fixedly connected to the first connecting rod 35. The second connecting rod 33 is hinged with the left bottom door 25. The transmission shaft 39 is hinged with two ends of the right bottom door 28. A piston rod end of the driving cylinder 36 is hinged with one end of the swing rod 34, and the other end of the swing rod 34 is hinged with the third connecting rod 40, while the other end of the third connecting rod 40 is fixedly connected with the transmission shaft 39. A center of rotation of the connection between the third connecting rod 40 and the transmission shaft 39, a center of rotation between the connection of the first connecting rod 35 and the transmission shaft 39, and a hinged center formed between the transmission shaft 39 and the right bottom door 28 coincide with one another.

When the left bottom door 25 and the right bottom door 28 are in a closed position, as shown in FIG. 10, the inner edge 37 of the left bottom door and the lower beam 31.3 on the left side of the longitudinal saddle 31 are in contact with each other throughout the length along the longitudinal direction of the car body 6, and at the same time, the outer edge of the left bottom door 25 is still in contact with the side beam 29 throughout the length on one side of the car body 6 along the longitudinal direction, thereby closing the left discharge port. Similarly, the right inner edge 38 of the right bottom door is in contact with the lower side beam 31.3 throughout the length on the right side of the longitudinal saddle 31 along the longitudinal direction of the car body 6; at the same time, the outer edge of the right bottom door 28 is in contact with the side beam 29 on the other side of the car body 6 throughout the length along the longitudinal direction, thereby closing the right discharge port. That is, when the left bottom door 25 and the right bottom door 28 are in the closed position, the left bottom door 25 and the right bottom door 28 are simply overlapped with the lower side beams 31.3 on both sides of the longitudinal saddle 31, respectively, and the left bottom door 25 and the right bottom door 28 are not in contact with each other. Therefore, no matter whether the left bottom door 25 is closed firstly or the right bottom door 28 is closed firstly, they will not interfere with each other, thereby eliminating the sequential requirement to close the two doors, and removing the sequence cylinder 26 or sequence device in the bottom door opening and closing mechanism 23 in the prior art, thus the structure of the bottom door opening and closing mechanism is simplified, and the manufacture and maintenance costs thereof are reduced, and the operational reliability is further improved.

When the left bottom door 25 and the right bottom door 28 are in a fully open position, as shown in FIG. 11, the inner edge 37 of the left bottom door is separated from the lower side beam 31.3 on the left side of the longitudinal saddle 31, thereby opening the left discharge port; the inner edge 38 of the right bottom door is separated from the lower side beam 31.3 on the right side of the longitudinal saddle 31, thereby opening the right discharge port; after the left discharge port and the right discharge port are opened, due to its own weight, the cargo is discharged to the center of the track under the guidance of the door plates of the left bottom door 25 and the right bottom door 28 and the left and right side plates 31.1 of the longitudinal saddle 31.

Further, on the condition that the transversal width of the car body 6 is determined, the transversal widths of the left bottom door 25 and the right bottom door 28 are inversely proportional to the lateral width L of the bottom of the longitudinal saddle 31. Thus, the larger the transversal width L of the bottom of the longitudinal saddle 31 is, the smaller the transversal widths of the left bottom door 25 and the right bottom door 28 are. Therefore, by adjusting the transversal width L of the bottom of the longitudinal saddle 31, the transversal widths of the left bottom door 25 and the right bottom door 28 can be adjusted to solve the problem that the bottom door of a vehicle having a wide width, such as a vehicle having a wide gauge, enters into a limited area under the vehicle when the bottom door is fully opened. At the same time, the self-weights of the left bottom door 25 and the right bottom door 28 are reduced by reducing the transversal widths thereof, so as to reduce the opening and closing resistance thereof and thus improve the opening and closing performance.

When the left bottom door 25 and the right bottom door 28 are in the open position, a minimum distance between the door plates of the left bottom door 25 and the right bottom door 28 and the lower side beams 31.3 on both sides of the longitudinal saddle 31 is an opening degree of the bottom door. On the condition that the width of the discharge port of the car body 6 is determined, the opening degree of the bottom door is inversely proportional to the transversal width L of the bottom of the longitudinal saddle 31, and the larger the L is, the smaller the opening degrees of the left bottom door 25 and the right bottom door 28 are. Therefore, by adjusting the transversal width L of the bottom of the longitudinal saddle 31, the opening degrees of the left bottom door 25 and the right bottom door 28 can be adjusted to realize adjustment and control of cargo unloading flow, thereby improving the ability of the vehicle to adapt to ground transit facilities of different capacities.

The transversal width L of the bottom of the longitudinal saddle 31 and the inclination angle $\alpha$ of the side plates 31.1 can be varied according to the needs of the vehicle, thereby forming a series of specifications of various transversal bottom widths L and side plate inclinations $\alpha$. For a vehicle operating in a certain condition and carrying a certain cargo or operating under other constant conditions, a longitudinal saddle 31 with parameters of a transversal bottom width L and a side plate inclination $\alpha$ which are matched with the vehicle may be used; for a vehicle operating in various conditions and carrying various kinds of cargoes, a longitudinal saddle 31 with a series of parameters of transversal bottom widths L and side plate inclinations $\alpha$ may be used.

The longitudinal saddle 31 can be replaced corresponding to different operating conditions and different cargoes. That is, the longitudinal saddle may be connected to the car body by bolts, and can be disassembled to be replaced by a longitudinal saddle 31 of different specifications. Therefore, different widths of discharge port can be obtained to achieve different unloading flow and meet the requirements of vehicles for transporting different cargoes and adapting to the capacity of different ground transit facilities.

In summary, on the condition that the transversal width of the car body 6 is determined, by adjusting the transversal width L of the bottom of the longitudinal saddle 31, the transversal widths of the left bottom door 25 and the right bottom door 28 and the opening degree thereof can be adjusted, thereby accordingly reducing self-weight, improving opening and closing performance, and realizing adjustment and control of cargo unloading flow. In addition, for a vehicle operating in a certain condition and carrying a certain cargo or operating under other constant conditions, a longitudinal saddle 31 with parameters of a transversal bottom width L and a side plate inclination $\alpha$ which are matched with the vehicle may be used. For a vehicle operating in various conditions and carrying various kinds of cargoes, a longitudinal saddle 31 with a series of parameters of transversal bottom width L and side plate inclinations $\alpha$ may be used and the longitudinal saddle 31 can be replaced corresponding to different operating conditions and different cargoes.

Figure 3:
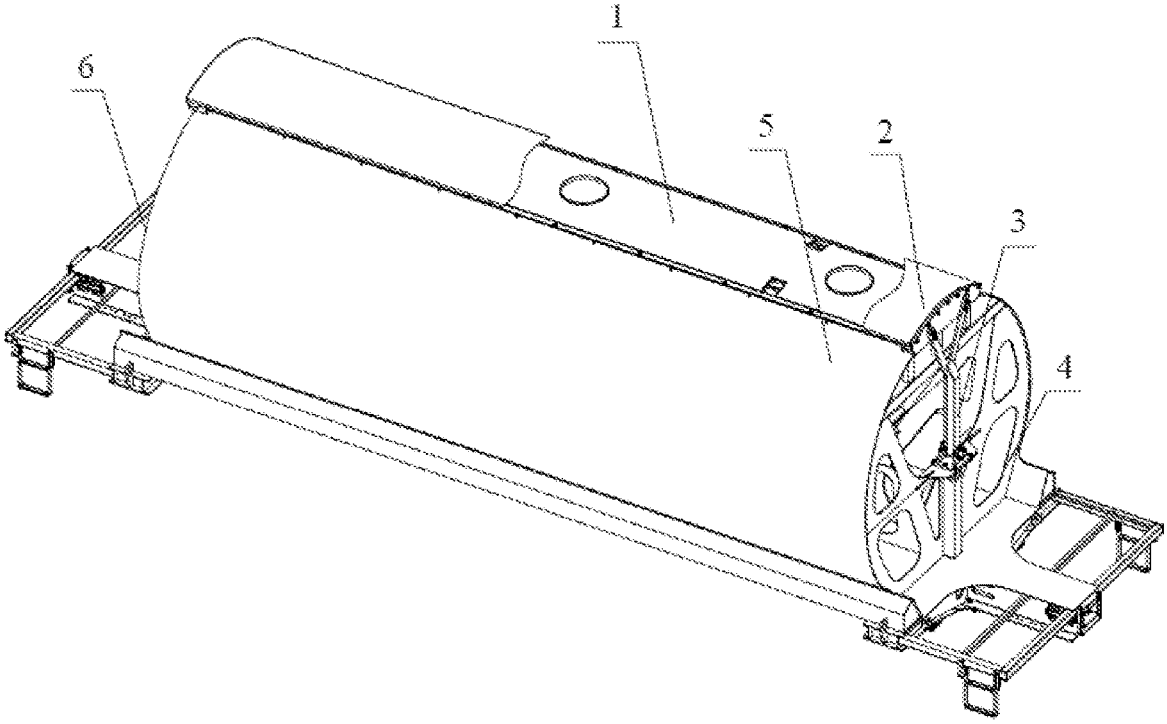
FIG. 3 is a schematic structural view showing a mounting structure of a double-layer top cover in FIG. 2.

Further, referring to FIG. 3, the top cover according to embodiments of the present invention is a double-layer top cover 20. The double-layer top cover 20 includes a fixed top cover 1, a movable top cover 2, and a top cover opening and closing mechanism 3. The fixed top cover 1 is detachably connected to a top opening of the car body 6. The movable top cover 2 is movably connected to the top opening of the car body 6 through the top cover opening and closing mechanism 3.

Figure 6:
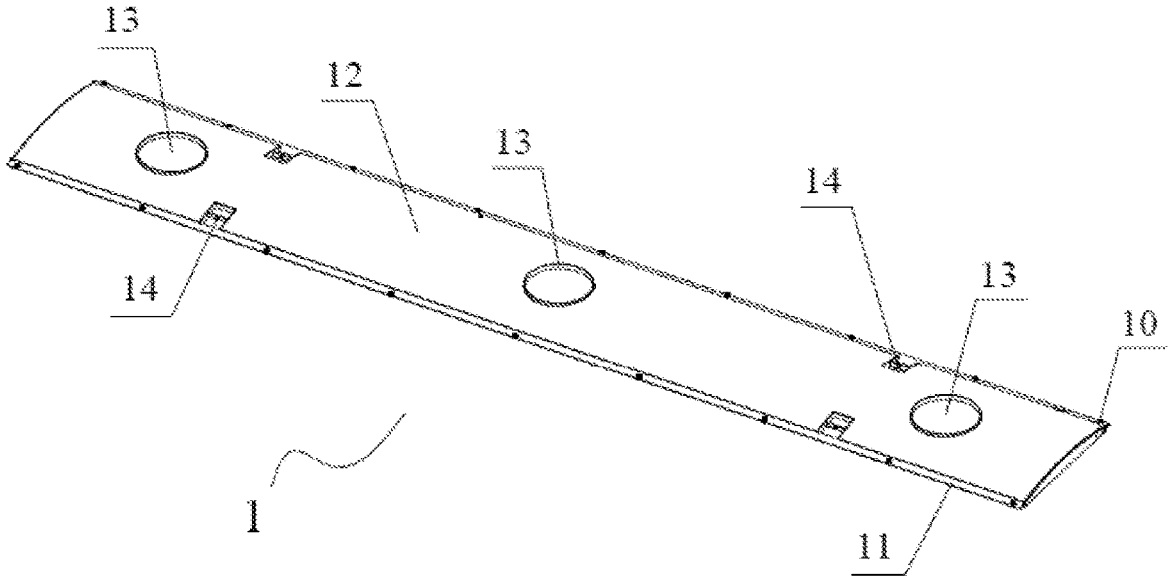
FIG. 6 is a schematic structural view showing a fixed top cover in FIG. 3 according to an embodiment of the invention.
Figure 7:
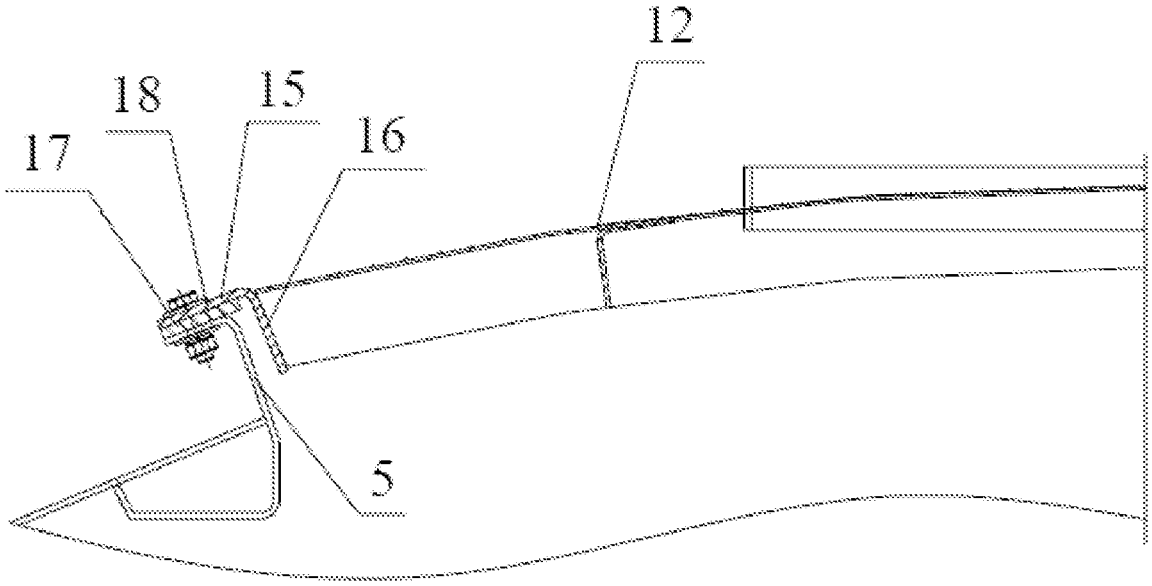
FIG. 7 is a schematic structural view showing a connection structure of a fixed top cover and a car body according to an embodiment of the present invention.
Figure 8:
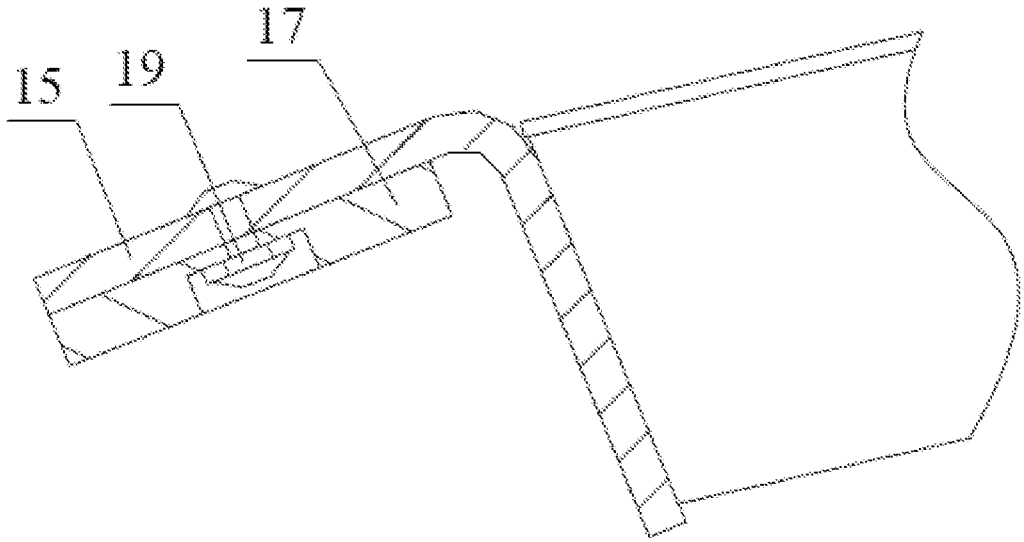
FIG. 8 is a schematic view showing a mounting structure of a fixed top cover in FIG. 7 and a side sealing gasket.
Figure 9:
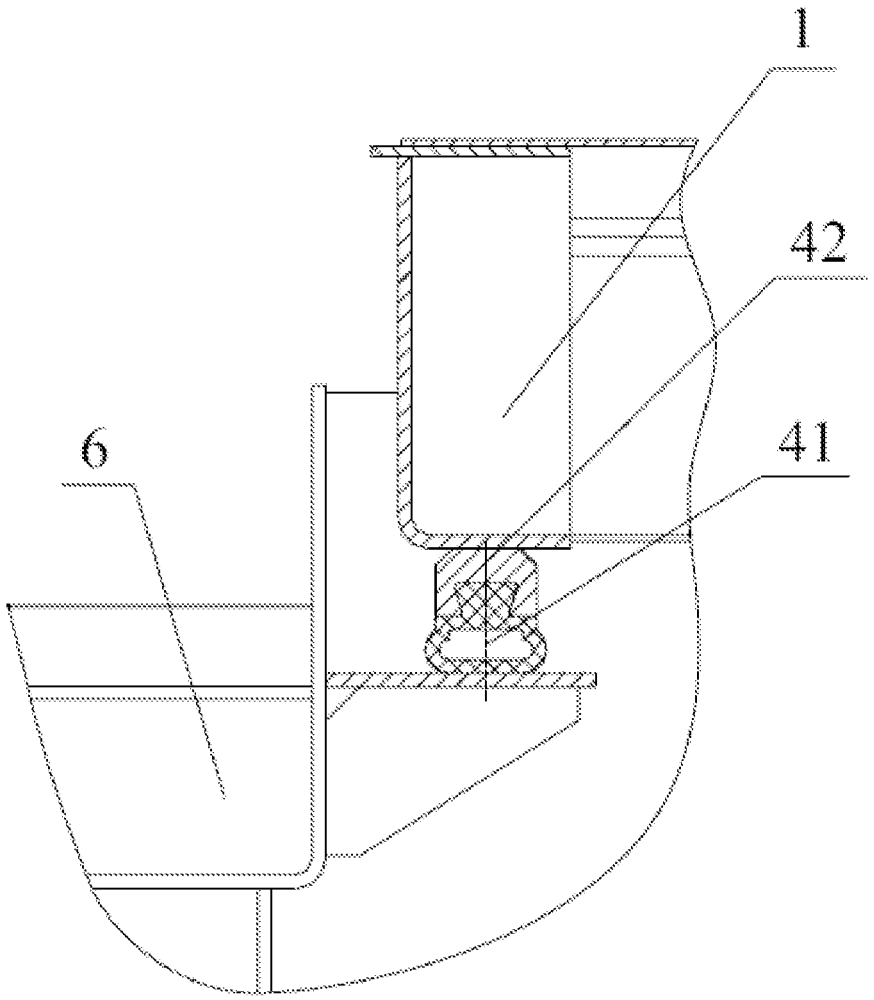
FIG. 9 is a schematic view showing a mounting structure of a fixed top cover in FIG. 7 and a rubber sealing gasket.

As shown in FIG. 6, the fixed top cover 1 includes a frame 10, a cover plate 12 mounted on the frame 10, a loading port 13 formed in the cover plate 12, and a lifting ring 14 disposed on the cover plate 12 for lifting. In this embodiment, the front and rear edges of the frame 10 are both L-shaped beams 11, and the L-shaped beams 11 include transversal edges 15 and vertical edges 16. The transversal edges 15 are connected to the side walls 5 of the car body 6 by overlapping structures. That is, the transversal edges 15 rest on outer edges 18 extending outwardly from the top ends of the side walls 5 of the car body 6, and then the transversal edges 15 and the outer edges 18 are fixedly connected together by bolts. In addition, there is a gap left between the vertical edges 16 and inner surfaces of the side walls 5 of the car body 6 to facilitate installation and removal of the fixed top cover 1. The gap may be 5 to 10 mm, preferably 7 to 8 mm, as shown in FIG. 7. At the same time, two ends of the frame 10 are sealingly connected with the end wall 4 of the car body 6 by a rubber sealing gasket 41, and the rubber sealing gasket 41 is fixed to an end edge of the frame 10 by welding through a dovetail channel iron 42, as shown in FIG. 9. A side sealing gasket 17 is lined between the transversal edge 15 of the frame 10 and the outer edge 18, and the side sealing gasket 17 is riveted to the transversal edge 15 of the frame 10 by rivets 19 to achieve sealing performance of the fixed top cover 1, as shown in FIG. 8.

The top cover opening and closing mechanism 3 includes a rocker 8 which is fixedly connected to the end of the movable top cover 2 by riveting or bolting, and a rocker support 9 which is connected to the other end of the rocker 8 through a pin shaft 7. The rocker support 9 is fixed on the end wall 4 of the car body 6. At the same time, both sides of the movable top cover 2 and the side walls 5 are structurally sealed. The rocker 8 rotates the movable top cover 2 around the pin shaft 7 on the rocker support 9 under the action of external driving force (including manual driving or cylinder driving) to realize opening and closing of the movable top cover 2.

In this embodiment, the cover plate 12 is provided with four lifting rings 14 for lifting. The four lifting rings 14 are divided into two groups, each group consisting of two lifting rings. The two groups of lifting rings 14 are symmetrically distributed along a longitudinal central line of the cover plate 12, and two lifting rings 14 of each group of lifting rings 14 are symmetrically distributed along a transversal central line of the cover plate 12, thereby ensuring a stable lifting of the cover plate 12 without colliding with the car body or the movable top cover and facilitating removal or replacement of the fixed top cover 1. In addition, in order to enable one vehicle to transport different cargoes and adapt to different ground loading facilities so as to obtain versatility of the fixed top cover 1. In this embodiment, a series of fixed top covers 1 may be respectively manufactured for different cargoes and ground loading facilities to form a kit of fixed top covers, which have the same main body and the same external dimension and can be commonly used in the same car model, but with different numbers and shapes of loading ports; for example, the number of loading ports 13 may be 2-4, and the shape thereof may be circular or square.

Figure 4:
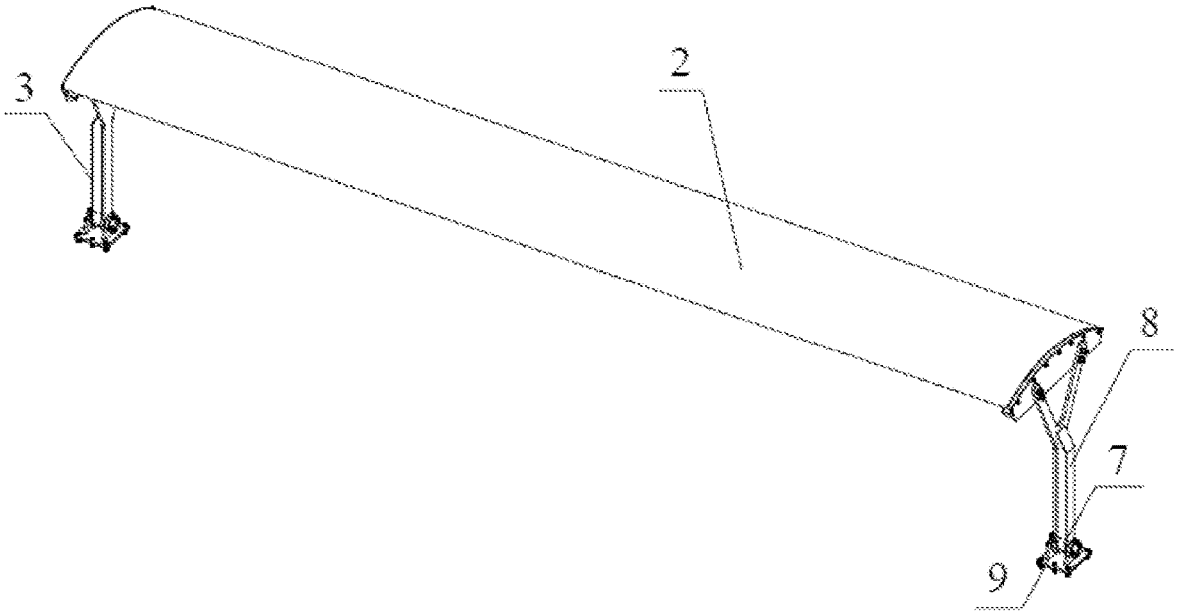
FIG. 4 is a schematic structural view showing a movable top cover in FIG. 3 according to an embodiment of the invention.
Figure 5:
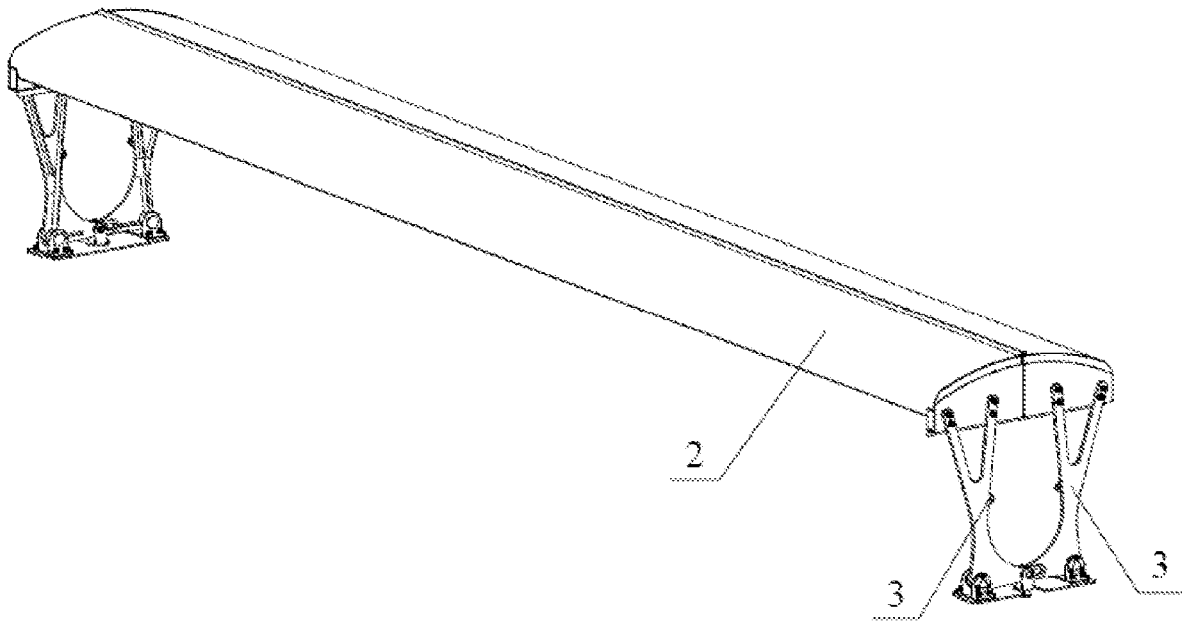
FIG. 5 is a schematic structural view showing a movable top cover in FIG. 3 according to another embodiment of the invention.

Of course, the movable top cover 2 of the present invention can be a single-side opening movable top cover or a double-side opening movable top cover. FIG. 4 shows a single-side opening movable top cover, and FIG. 5 shows a double-side opening movable top cover.

The double-layer top cover 20 consisting of a detachable fixed top cover 1 and an openable movable top cover 2 effectively increases the range of cargoes that can be loaded by a covered hopper car. By replacing a fixed top cover with another fixed top cover of a different form of loading port or directly disassembling the fixed top cover, the requirements for the covered hopper car to load a variety of cargoes and adapt to a variety of ground loading facilities can be met, thereby increasing the capability of the car to transport different kinds of cargoes of different characteristics, enhancing the capability of the car to adapt to different conditions of different kinds of cargo loading facilities, and achieving multi-purpose use of a single car and greatly improving applicable performance of the car, and further improving transportation and operation efficiency of the car.

When the car is equipped with both of the movable top cover 2 and the fixed top cover 1, the car is suitable for stationary loading with a single hopper or multiple loading hoppers, a loading pipe, and the like, and has facility conditions satisfying loading requirements of preventing cargo leakage, flying, etc., and is suitable for loading and transporting cargoes which themselves have more dust and more pollution and need to be protected from rain, sand and other contaminants.

When the car is only equipped with the movable top cover 2 and the fixed top cover 1 being removed, the car is suitable for mobile loading with a single loading hopper or multiple loading hoppers, a loader, a conveyor belt, and the like, and has facility conditions free from loading requirements of preventing cargo leakage, flying, etc., and is suitable for loading and transporting cargoes which themselves have less dust and less pollution and need to be protected from rain, sand and other contaminants.

When the car removes the movable top cover 2 and the fixed top cover 1, that is, when there is no top cover, the car is suitable for mobile loading with a single loading hopper or multiple loading hoppers, a loader, and the like, and has facility conditions free from loading requirements of preventing cargo leakage, flying, etc., and free from sealing requirements, and is suitable for loading and transporting cargoes which themselves have less dust and less pollution and need not to be protected from rain, sand and other contaminants.

The invention claimed is:

1. A railway hopper car comprising:

a car body (6) and a top cover mounted at a top opening of the car body (6), and a bogie (24), a braking device (21) and a coupler buffer device (22) each mounted under a chassis of the car body (6), as well as a bottom door and a bottom door opening and closing mechanism (23) mounted at a discharge port at the bottom of the chassis, wherein the bottom door includes a left bottom door (25) and a right bottom door (28) rotatably mounted at the bottom of the discharge port of the car body (6), and the left bottom door (25) and the right bottom door (28) are symmetrically arranged about a longitudinal central line of the car body (6) in a length direction thereof, and wherein the railway hopper car further comprises a longitudinal saddle (31) disposed in the center of the car body (6) in the length direction thereof and arranged along the longitudinal direction of the car body (6), wherein the longitudinal saddle (31) includes two side plates (31.1) and a saddle top (31.2) connected tops of the two side plates (31.1), as well as lower side beams (31.3) respectively disposed below inner side surfaces of the side plates (31.1), and two ends of each of the two side plates (31.1) are respectively fixed to end plates of the discharge port of the car body (6) through end connecting plates (27) at both ends of the discharge port; the bottom door opening and closing mechanism (23) drives the left bottom door (25) and the right bottom door (28) to rotate, so that an inner edge (37) of the left bottom door (25) and an inner edge (38) of the right bottom door (28) are respectively overlapped with or separated from the lower side beams (31.3) at two sides of the longitudinal saddle (31); and the top cover is a double-layer top cover (20), and the double-layer top cover (20) comprises a fixed top cover (1), a movable top cover (2) and a top cover opening and closing mechanism (3), and the fixed top cover (1) is detachably connected to the top opening of the car body (6), and the movable top cover (2) is movably connected to the top opening of the car body (6) through the top cover opening and closing mechanism (3); the top cover opening and closing mechanism (3) includes a rocker (8) with one end fixedly connected to an end of the movable top cover (2) and a rocker support (9) connected to the other end of the rocker (8) through a pin shaft (7), the rocker support (9) being fixed to an end wall (4) of the car body (6).

2. The railway hopper car according to claim 1, wherein the bottom door opening and closing mechanism (23) includes a first connecting rod (35), a second connecting rod (33) hinged with the first connecting rod (35), a driving cylinder (36) connected to an end beam (30) of the car body (6), a swing rod (34) hinged with the driving cylinder (36), a third connecting rod (40) hinged with the swing rod (34), and a transmission shaft (39) fixedly connected to the first connecting rod (35); the second connecting rod (33) is hinged with the left bottom door (25), and the transmission shaft (39) is hinged with two ends of the right bottom door (28), and a piston rod end of the driving cylinder (36) is hinged with one end of the swing rod (34), and the other end of the swing rod (34) is hinged with the third connecting rod (40), and the other end of the third connecting rod (40) is fixedly connected to the transmission shaft (39); a center of rotation between the connection of the third connecting rod (40) and the transmission shaft (39), a center of rotation between the connection of the first connecting rod (35) and the transmission shaft (39), and a hinged center formed by the transmission shaft (39) and the right bottom door (28) coincide with one another.

3. The railway hopper car according to claim 2, wherein the movable top cover (2) is a one-side opening movable top cover or a double-side opening movable top cover.

4. The railway hopper car according to claim 1, wherein the fixed top cover (1) comprises a frame (10), a cover plate (12) mounted on the frame (10), a loading port (13) formed in the cover plate (12), and a lifting ring (14) provided on the cover plate (12) for lifting, and wherein an edge of the frame (10) is fixedly mounted by bolts on an outer edge (18) extended outward from the top of the side walls (5) of the car body (6); two ends of the frame (10) are sealingly connected with end walls (4) of the car body (6) through a rubber sealing gasket (41), and the rubber sealing gasket (41) is fixed by welding on an end edge of the frame (10) through a dovetail channel iron (42); and a side sealing gasket (17) is lined between the edge of the frame (10) and the outer edge (18), and the side sealing gasket (17) is riveted to the edge of the frame (10) by rivets (19).

5. The railway hopper car according to claim 4, wherein the movable top cover (2) is a one-side opening movable top cover or a double-side opening movable top cover.

6. The railway hopper car according to claim 4, wherein the edge of the frame (10) is an L-shaped beam (11), and the L-shaped beam (11) includes a transversal edge (15) and a vertical edge (16); the transversal edge (15) is fixedly mounted by bolts on the outer edge (18) extending outward from the top end of the side walls (5) of the car body (6), and there is a gap between the vertical edge (16) and an inner surface of the side walls (5) of the car body (6).

7. The railway hopper car according to claim 6, wherein the movable top cover (2) is a one-side opening movable top cover or a double-side opening movable top cover.

8. The railway hopper car according to claim 1, wherein two longitudinal top ends of the left bottom door (25) are respectively hinged on two lifting lugs (32) on one side of the lower surface of the end beam (30), and a longitudinal outer edge of the left bottom door (25) is in contact with a side beam (29) on one side of the car body (6); two longitudinal top ends of the right bottom door (28) are respectively hinged on two lifting lugs (32) on the other side of the lower surface of the end beam (30), and a longitudinal outer edge of the right bottom door (28) is in contact with a side beam (29) on the other side of the car body (6).

9. The railway hopper car according to claim 8, wherein the movable top cover (2) is a one-side opening movable top cover or a double-side opening movable top cover.

10. The railway hopper car according to claim 1, wherein a plurality of partition plates (31.4) are provided between the two side plates (31.1) along the length direction of the longitudinal saddle (31).

11. The railway hopper car according to claim 10, wherein the movable top cover (2) is a one-side opening movable top cover or a double-side opening movable top cover.

12. The railway hopper car according to claim 1, wherein a transversal width of each of the left bottom door (25) and the right bottom door (28) is inversely proportional to a transversal width of the bottom of the vertical saddle (31).

13. The railway hopper car according to claim 12, wherein the movable top cover (2) is a one-side opening movable top cover or a double-side opening movable top cover.

14. The railway hopper car according to claim 1, wherein the movable top cover (2) is a one-side opening movable top cover or a double-side opening movable top cover.

* * * * *